US009481995B2

(12) United States Patent
Bemis

(10) Patent No.: US 9,481,995 B2
(45) Date of Patent: Nov. 1, 2016

(54) METHOD OF APPLYING FOAM COMPOSITIONS

(71) Applicant: Gaco Western, LLC, Waukesha, WI (US)

(72) Inventor: Jonathan William Bemis, Gray, ME (US)

(73) Assignee: Gaco Western, LLC, Waukesha, WI (US)

( * ) Notice: Subject to any disclaimer, the term of this patent is extended or adjusted under 35 U.S.C. 154(b) by 0 days.

(21) Appl. No.: 15/144,589

(22) Filed: May 2, 2016

(65) Prior Publication Data

US 2016/0244963 A1 Aug. 25, 2016

Related U.S. Application Data

(63) Continuation-in-part of application No. 14/674,954, filed on Mar. 31, 2015, now abandoned.

(60) Provisional application No. 62/074,537, filed on Nov. 3, 2014.

(51) Int. Cl.

| | |
|---|---|
| ***E04B 1/76*** | (2006.01) |
| ***E04B 1/78*** | (2006.01) |
| ***E04B 1/88*** | (2006.01) |
| ***E04C 2/284*** | (2006.01) |
| ***E04C 2/34*** | (2006.01) |
| ***E04C 2/20*** | (2006.01) |

(52) U.S. Cl.

CPC ..... *E04B 1/7604* (2013.01); *E04B 1/78* (2013.01); *E04B 1/88* (2013.01); *E04C 2/205* (2013.01); *E04C 2/284* (2013.01); *E04C 2/3405* (2013.01); *E04C 2002/3488* (2013.01)

(58) Field of Classification Search

CPC ..... E04B 1/78; E04B 1/88; E04B 1/7604; E04B 2/56; E04B 2/562; E04C 2/205; E04C 2/284; E04C 2/3405; E04C 2002/3488

USPC ..... 52/404.1, 404.3, 406.1, 407.1, 407.3

See application file for complete search history.

(56) References Cited

U.S. PATENT DOCUMENTS

| | | | | | |
|---|---|---|---|---|---|
| 1,726,040 | A | * | 8/1929 | Olson | E04B 1/7654 428/121 |
| 2,047,236 | A | * | 7/1936 | Thomas | E04B 1/7654 252/DIG. 18 |
| 2,782,914 | A | * | 2/1957 | Giles | E04B 1/7654 428/101 |
| 4,140,661 | A | | 2/1979 | Connett et al. | |
| 4,177,618 | A | | 12/1979 | Felter | |
| 4,239,564 | A | | 12/1980 | Krumweide | |
| 4,292,777 | A | | 10/1981 | Story | |
| 4,385,477 | A | * | 5/1983 | Walls | E04B 1/7604 52/220.1 |
| 4,829,738 | A | | 5/1989 | Moss | |
| 5,287,674 | A | | 2/1994 | Sperber | |
| 5,355,653 | A | | 10/1994 | Henri | |
| 5,365,716 | A | * | 11/1994 | Munson | E04B 1/7604 52/404.1 |

(Continued)

*Primary Examiner* — Brian Glessner
*Assistant Examiner* — Adam Barlow
(74) *Attorney, Agent, or Firm* — Michael Best & Friedrich LLP

(57) ABSTRACT

Methods of applying a foam composition to a cavity in a building structure are provided. The methods include introducing a foam composition into a cavity defined by a wall, a plurality of structural members, and a plastic membrane affixed to one or more faces of the structural members and one or more sides of the structural members defining the cavity.

20 Claims, 5 Drawing Sheets

(56) References Cited

U.S. PATENT DOCUMENTS 5,641,368 A * 6/1997 Romes ..... B05B 7/1409 156/293
5,697,198 A 12/1997 Ponder et al.
6,490,842 B2 12/2002 Emmons
6,557,313 B1 * 5/2003 Alderman ..... B32B 7/02 52/407.2
7,127,856 B2 10/2006 Hagen, Jr. et al.
7,263,810 B1 * 9/2007 Trauba ..... E04B 1/7604 52/404.1
2006/0201089 A1 9/2006 Duncan et al.
2007/0214739 A1 9/2007 Sherner
2010/0175810 A1 7/2010 Korwin-Edson et al.
2010/0319275 A1 * 12/2010 O'Leary ..... E04B 1/7604 52/173.1
2012/0124927 A1 5/2012 Hastings

* cited by examiner

METHOD OF APPLYING FOAM COMPOSITIONS

CROSS-REFERENCE TO RELATED APPLICATIONS

This application is a continuation-in-part of co-pending U.S. patent application Ser. No. 14/674,954 filed on Mar. 31, 2015, which claims priority to U.S. Provisional Patent Application No. 62/074,537 filed on Nov. 3, 2014, the entire contents of each of which are incorporated herein by reference.

TECHNICAL FIELD

The present disclosure relates generally to methods of applying foam compositions.

BACKGROUND

Polyurethane spray foams have found widespread utility in the fields of insulation and structural reinforcement. These foams are commonly used to insulate or impart structural strength to items such as automobiles, hot tubs, refrigerators, boats, and building structures. The foam ingredients are typically mixed, heated, and pressurized, after which the foam is sprayed onto walls to fill various areas such as gaps, cracks, and spaces between wall studs. Upon spraying foam onto a surface, such as the space between wall studs, the foam expands, often beyond the plane defined by the faces of the wall studs. Consequently, after drying the foam is often trimmed flush to various surfaces (e.g., the dried foam is trimmed so the outer surface of the foam is flush with the faces of the wall studs). The excess foam trimmed away from the surfaces constitutes waste in terms of material cost, and further, the investment of time to trim, clean up, and dispose of the waste foam. There exists a need for improved methods of applying foam compositions that avoid production of excessive waste foam.

DETAILED DESCRIPTION

Figure 1:
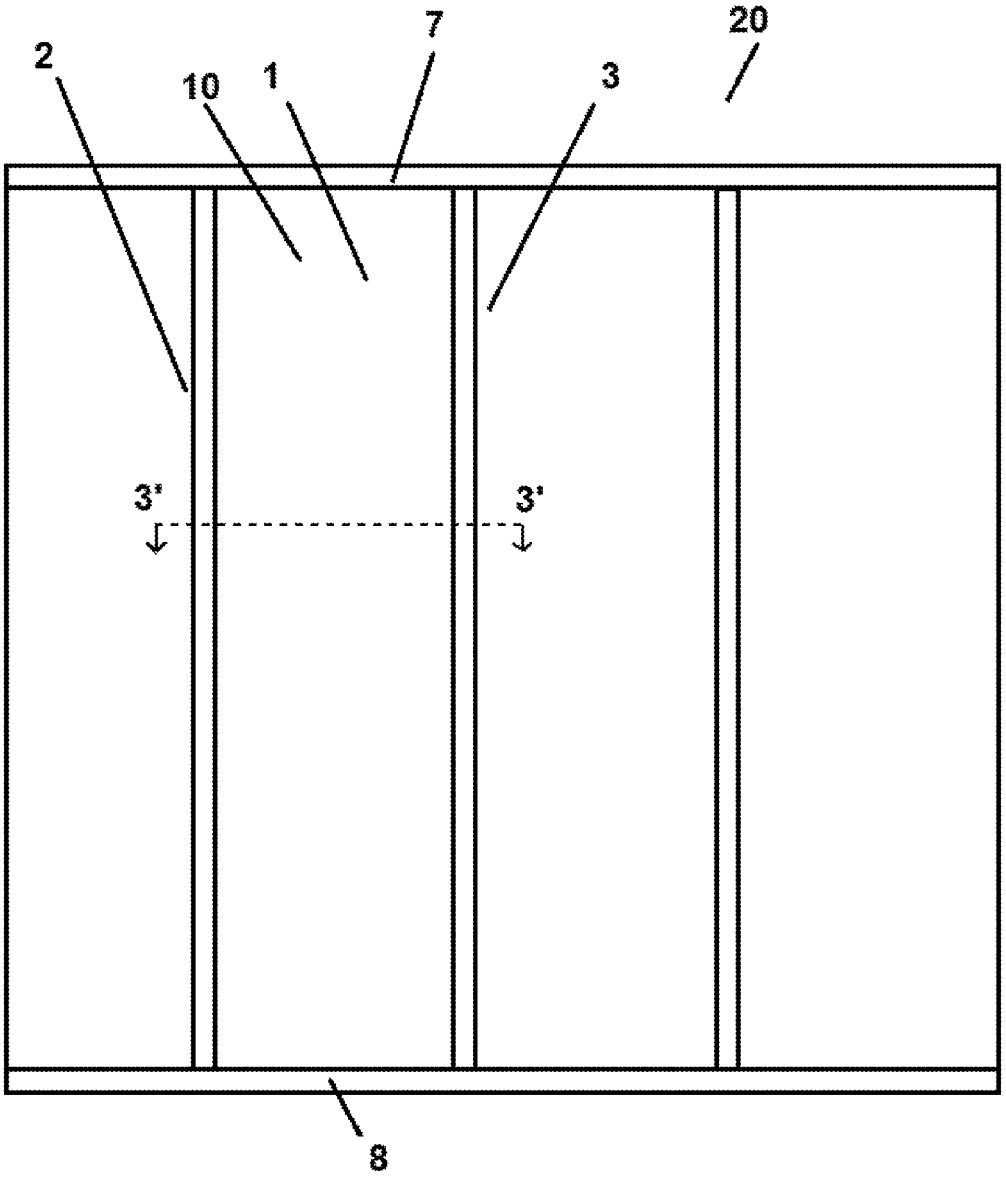
FIG. 1 depicts an exemplary building structure that can be subject to foam application.

Disclosed herein are methods of applying a foam composition (e.g., a polyurethane foam composition) to a cavity (e.g., a building cavity). The method includes applying a plastic membrane to the cavity. The plastic membrane can be applied to one or more front faces of the structures defining the cavity (e.g., studs, joists), and preferably, the membrane is held tight as it is applied to the front faces of the defining structures. The plastic membrane can be further affixed to one or more sides of one or more of the structures defining the cavity, thereby further tightening the membrane over the cavity. For example, the plastic membrane can be affixed to the one or more sides of one or more vertical studs (e.g., inset about 0.5 inch from the front face of the stud). A foam composition can be applied to the cavity with the plastic membrane affixed thereto. For example, a polyurethane foam can be sprayed or injected into the cavity (e.g., a spray foam gun can be used to pierce the plastic membrane and apply polyurethane foam into the cavity).

The disclosed methods are useful in a variety of sealing and insulation applications. These include, for example, building insulation such as for walls, foundations, floors and roofs; gap and crack filling and crack repair applications in buildings, masonry and other structures; vehicular cavity-filling applications, and the like.

The disclosed methods provide several advantages.

As one advantage, the methods allow for efficient application of foam to building structures. For example, the disclosed methods significantly reduce production of excess waste foam compared to conventional methods of applying foam directly to a building cavity (e.g., without installation of a barrier). The disclosed methods also obviate the need for use of rigid shields, metal screens, or the like to act as a barrier, as these structures have been used previously to prevent bulging of foam beyond the plane defined by the building cavity structures. Such methods that require use of shields or screens are laborious, and require significant investment of time and resources to transport, load/unload, and install/remove from the cavity of interest.

As another advantage, the disclosed methods allow for application of drywall or another select material directly to the cavity over the plastic membrane after the foam application is complete. In particular, the disclosed methods prevent or reduce bulging of the foam material beyond the plane defined by the cavity structures (e.g., beyond the plane defined by the faces of studs). In addition, the disclosed methods prevent or reduce inadvertent foam application to the faces of the cavity structures where drywall will be applied. As a result, the disclosed methods provide for improved efficiency in an insulation/drywall installation process.

As another advantage, the disclosed methods provide for use of the installed plastic membrane as a barrier. The plastic membrane can be a breathable material, or can be a vapor retarder, depending on the selected application and geographic location. Thus, the plastic membrane can facilitate foam application, and subsequently serve as a functional part of the building structure.

As another advantage, presence of the plastic membrane during the foam application process reduces worker exposure to the foam composition components and reactants (e.g., reduces exposure to airborne isocyanate droplets). Exposure to isocyanate droplets can lead to allergic reactions after contact with the skin or when respirated. The plastic membrane prevents or reduces exposure to such materials as the foam is sprayed or injected into a substantially enclosed cavity.

1. DEFINITION OF TERMS

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

The conjunctive term "or" includes any and all combinations of one or more listed elements associated by the conjunctive term. For example, the phrase "an apparatus comprising A or B" may refer to an apparatus including A where B is not present, an apparatus including B where A is not present, or an apparatus where both A and B are present. The phrases "at least one of A, B, . . . and N" or "at least one of A, B, . . . N, or combinations thereof" are defined in the broadest sense to mean one or more elements selected from the group comprising A, B, . . . and N, that is to say, any combination of one or more of the elements A, B, . . . or N including any one element alone or in combination with one or more of the other elements which may also include, in combination, additional elements not listed.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

As used herein, the term "open-cell" refers to individual cells that are ruptured or open or interconnected producing a porous "sponge" foam, where the gas phase can move around from cell to cell. An open-cell foam may be numerically composed of 10-100% open cells.

As used herein, the term "closed-cell" refers to individual cells that are discrete, such that each closed-cell is enclosed by polymeric sidewalls that minimize the flow of a gas phase from cell to cell. It should be noted that the gas phase may be dissolved in the polymer phase besides being trapped inside the closed-cell. Furthermore, the gas composition of the closed-cell foam at the moment of manufacture does not necessarily correspond to the equilibrium gas composition after aging or sustained use. Thus, the gas in a closed-cell foam frequently exhibits compositional changes as the foam ages. A closed-cell foam may be numerically composed of less than 10% open cells.

2. METHODS OF APPLICATION

Disclosed are methods of applying foam compositions. The methods can be used to apply foam to any selected cavity (e.g., a building cavity, or a pre-fabricated building structure). The cavity can be defined by at least one wall of material (e.g., an exterior wall) and a plurality of structural members (e.g., studs, joists, top plates, sole plates, supporting beams, and the like, and any combination thereof). A plastic membrane can be applied to the structural members defining the cavity to prepare the cavity for application of a foam composition into one or more open spaces within the cavity. The plastic membrane can be affixed to one or more faces of the structural members to cover the cavity. The plastic membrane can be further tightened over the cavity by affixing the plastic membrane to one or more sides of the structural members. With the plastic membrane applied over the cavity and affixed to one or more faces and one or more sides of the structural members, a foam composition can be applied to fill one or more open spaces in the cavity.

FIG. 1 shows an exemplary building to which foam composition can be applied using the disclosed methods. The building structure 20 includes a cavity 10 defined by a first wall 1, a first vertical structural member 2, a second vertical structural member 3, a first horizontal structural member 7, and a second horizontal structural member 8. The first vertical structural member may be a stud or a joist. The second vertical structural member may be a stud or a joist. The first horizontal structural member may be a top plate or a joist. The second horizontal structural member may be sole plate or a joist.

Figure 2:
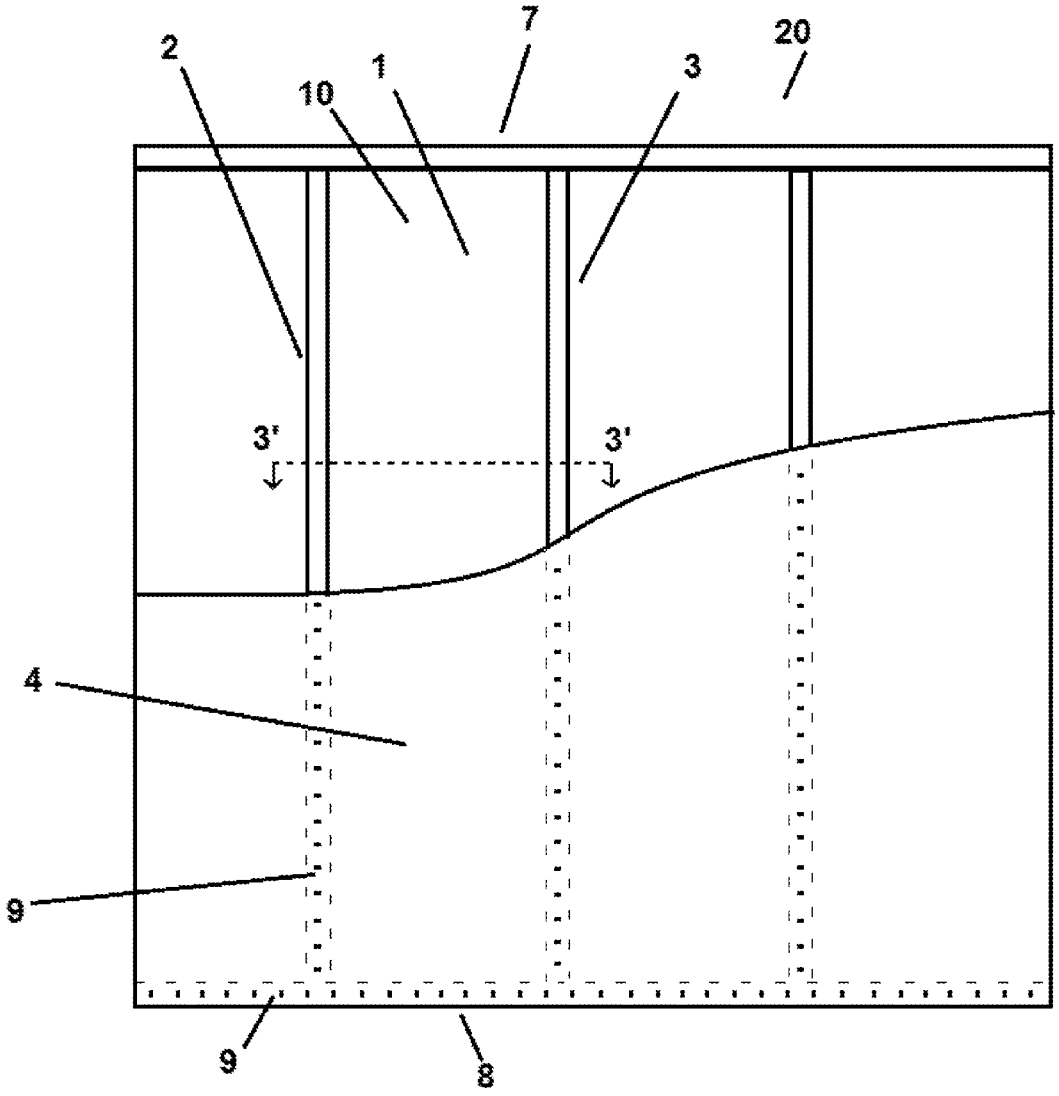
FIG. 2 depicts an exemplary building structure including a plastic membrane covering.

FIG. 2 shows the exemplary building structure of FIG. 1 with a cut-away view of a plastic membrane 4 as applied over the cavities defined by the structural members and the wall. The plastic membrane can be applied over cavity 10 by affixing the plastic membrane 4 to the face of the first vertical structural member 2, the face of the second vertical structural member 3, the face of the first horizontal structural member 7, and the face of the second horizontal structural member 8. The membrane can be affixed to the faces of the structural members using staples 9, for example. The staples can be located about 0.1 inch to about 2 inches apart from each other along the faces of the structural members. The plastic membrane can be held tight as it is affixed to the faces of the structural members.

In an exemplary embodiment, the plastic membrane 4 has a first edge, a second edge, a third edge, and a fourth edge. The plastic membrane can be applied to the building structure 20 by affixing the first edge to the face of first horizontal structure member 7, the second edge to the face of the second horizontal structural member 8, the third edge to the face of a vertical structural member at one side of the building structure, and the fourth edge to a vertical structural member at the other side of the building structure. The plastic membrane can be affixed to the faces of the plurality of vertical structures that are a part of the building structure 20. The order of affixing the plastic membrane to the vertical structural members and horizontal structural members can be varied as needed. For example, in certain embodiments, the plastic membrane can be affixed to the vertical structural members by moving from left to right (or right to left) along the building structure.

The plastic membrane can be further affixed to the structural members (e.g., the studs, joists, top plates, sole plates, supporting beams, and the like, or any combination thereof) by affixing the membrane to the sides of the members, preferably to the sides of the vertical structural members. For example, the plastic membrane can be affixed to one or both sides of the first vertical structural member 2 and one or both sides of the second vertical structural member 3 along the length of the vertical members between the first horizontal structural member 7 and the second horizontal structural member 8. The membrane can be affixed to the sides of the structural members using staples (e.g., 1-inch staples). The membrane can be affixed to the sides of the structural members with staples spaced about 0.3 inch to about 1 inch, preferably 0.5 inch, back from the face of the structural member to tighten the membrane over the cavity spaces(s). These inset staples can be located about 0.5 inch to about 3 inches, preferably 1.5 inches, apart from each other along the length of the structural members.

Figure 3:
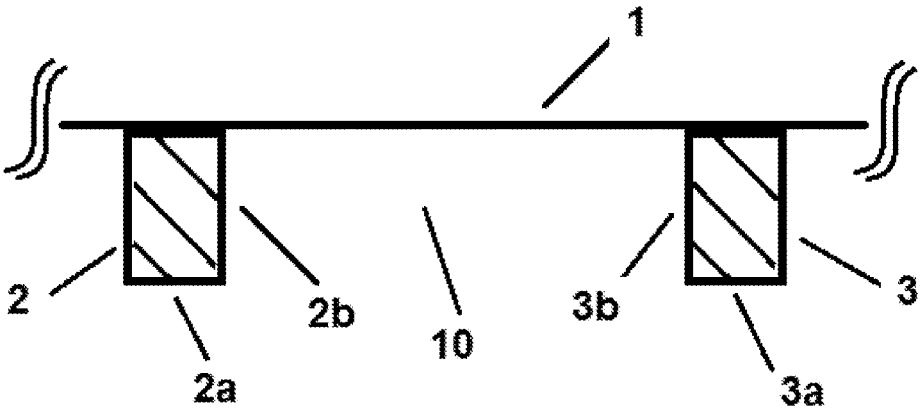
FIG. 3 depicts a top down cross sectional view 3'-3' of an exemplary cavity of a building structure.
Figure 4:
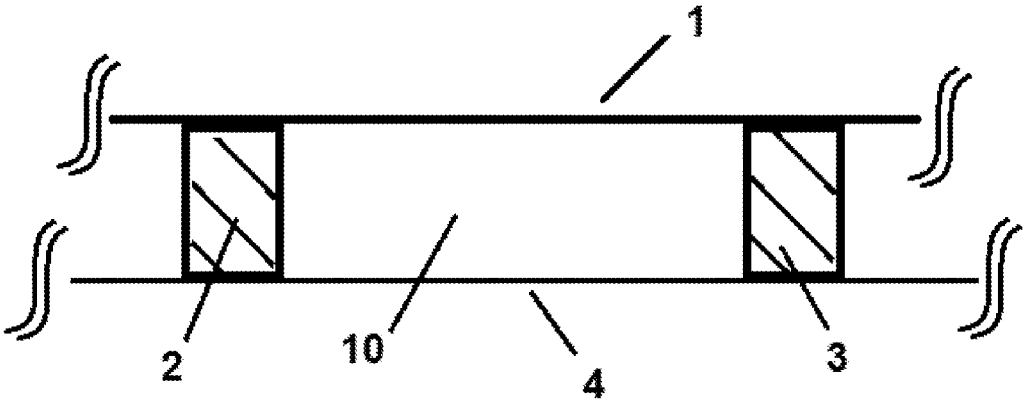
FIG. 4 depicts a top down cross sectional view 3'-3' of an exemplary cavity of a building structure with a plastic membrane affixed to the faces of the vertical structural members.
Figure 5:
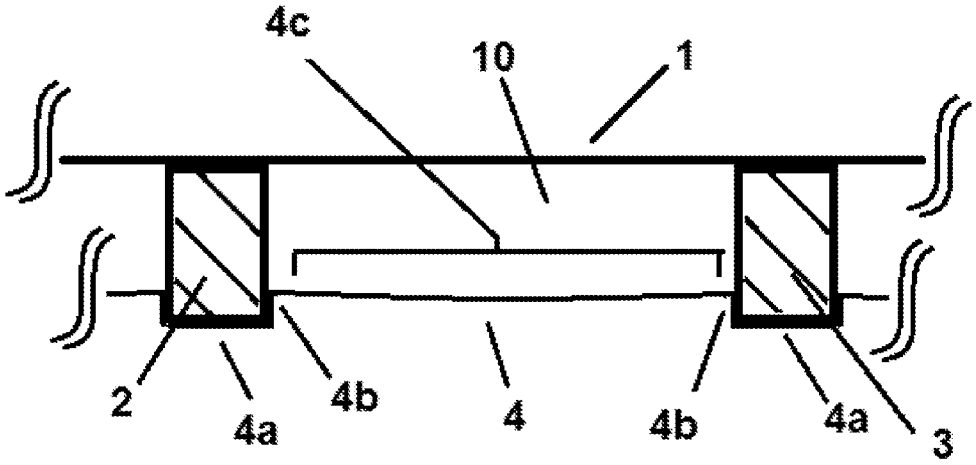
FIG. 5 depicts a top down cross sectional view 3'-3' of an exemplary cavity of a building structure with a plastic membrane affixed to the faces and the sides of the vertical structural members.

FIGS. 3-7 show a top down cross sectional view of the exemplary cavity 10 of FIGS. 1 and 2. FIGS. 3-7 exemplify a disclosed process of applying a plastic membrane to the cavity, and thereafter applying a foam composition to the cavity. FIG. 3 shows that the first vertical structural member 2 includes a face 2*a* and a side 2*b*; and that the second vertical structural member 3 includes a face 3*a* and a side 3*b*. The cavity 10 is initially defined by the first wall 1, sides 2*b* and 3*b*, the bottom of the first horizontal structural member, and the top of the second horizontal structural member (top and bottom of the cavity not shown). FIG. 4 shows the cavity 10 after the plastic membrane 4 has been applied by affixing the membrane to the faces 2*a* and 3*a* (and to the faces of the first horizontal structural member 7 and second horizontal structural member 8, not shown). FIG. 5 shows the cavity 10 after the plastic membrane 4 has been further tightened by affixing the membrane 4 to the sides 2*b* and 3*b* of the first and second vertical structural members. As shown, the membrane 4 is stretched to extend beyond the elastic limit of the material, stretched about the shared edges of the sides 2*b*, 3*b* and faces 2*a*, 3*a*, respectively, of the vertical structural members 2, 3. Stretching the membrane 4 beyond its elastic limit distorts or deforms the membrane 4 from an original, unstretched size (FIG. 4) to a stretched size (FIG. 5). The plastic membrane 4 thus has portions 4*a* affixed to the faces of the vertical structural members, and portions 4*b* affixed to the sides of the vertical structural members, which results in a portion 4*c* of the membrane held tight and suspended in the space between the first and second vertical structural members.

Figure 6:
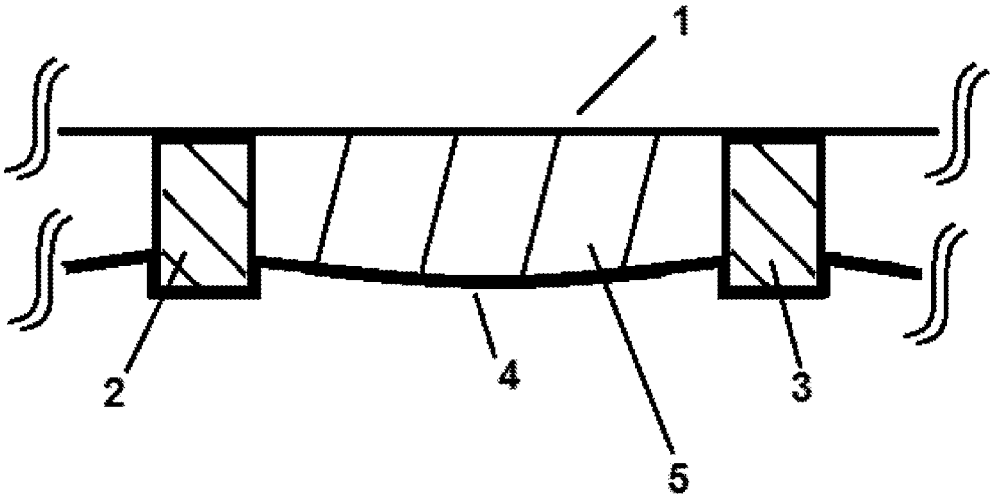
FIG. 6 depicts a top down cross sectional view 3'-3' of an exemplary cavity of a building structure with foam composition applied behind the plastic membrane covering the cavity.

Once the plastic membrane 4 is installed over the cavity 10, a foam composition can be introduced into the cavity. The foam can be applied to the cavity by spraying or injecting a foam composition through an access point in the plastic membrane. The access point in the membrane may be created by forming a hole through the membrane (e.g., a hole created by punching the tip of a foam spray gun through the membrane). FIG. 6 shows a top down cross sectional view of the exemplary cavity 10 wherein foam 5 (e.g., polyurethane foam) has been applied to fill the cavity. The foam resides in the space between the first and second vertical structural members. With a self-compressing foam (described in more detail in 3. Foam Compositions below), the foam pushes against the membrane 4, stretching the portion of the membrane 4 between the sides 2*b*, 3*b* beyond its elastic limit due to the pressure and heat of the rising foam. After a duration (e.g., one minute), the foam self-compresses within the cavity 10, leaving the membrane 4 looser than before the foam was injected into the cavity 10 as a result of having been stretched beyond its elastic limit. The plastic membrane 4 reduces or prevents the foam from bulging beyond the plane defined by the faces 2*a* and 3*a* of the first and second vertical structural members. As shown in FIG. 6, the plastic membrane confines the foam to a generally convex shape between the first and second vertical structural members, and prevents the foam from reaching the faces 2*a* and 3*a* of the vertical structural members, as well as the faces of the first and second horizontal structural members (horizontal structural members not shown). In certain embodiments, the foam composition can be applied in increments to the cavity, for example, to build a 3 foot column of foam material.

Figure 7:
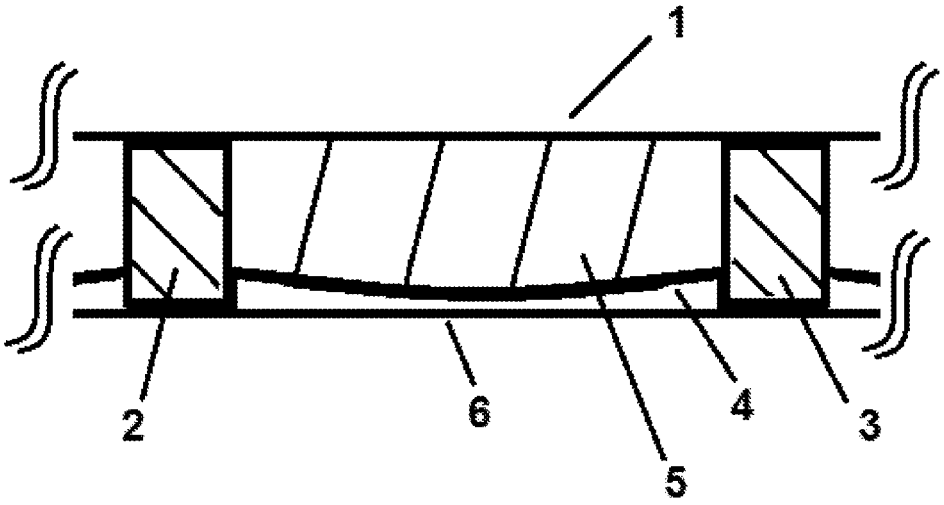
FIG. 7 depicts a top down cross sectional view 3'-3' of an exemplary cavity of a building structure with drywall applied over the cavity after foam application into the cavity behind the plastic membrane covering.

After the foam composition is applied to the cavity, a selected material (e.g., drywall) may be applied directly over the plastic membrane and foam composition confined behind the membrane. Because the plastic membrane protects the faces of the structural members from foam exposure, and the membrane reduces or prevents the foam from bulging, a material such as drywall can be applied directly to the building structure 20 over the membrane 4. FIG. 7 shows a top down cross sectional view of exemplary cavity 10 where drywall 6 has been applied to the cavity after foam application into cavity 10 behind plastic membrane 4.

The plastic membrane as referred to herein can be made from any selected plastic material appropriate for the building structure, the climatic location, and desired performance parameters from the insulation system. In certain embodiments, the plastic membrane is a poly membrane material. In certain embodiments, the plastic membrane comprises polyethylene or polypropylene. In certain embodiments, the plastic membrane is a fiber reinforced plastic membrane. In certain embodiments, the plastic membrane is a spun bond plastic membrane. In certain embodiments, the plastic membrane has a tensile strength of about 10 lbf/inch to about 150 lbf/inch. In certain embodiments, the plastic membrane has a tensile strength of about 10 lbf/inch, about 20 lbf/inch, about 30 lbf/inch, about 40 lbf/inch, about 50 lbf/inch, about 60 lbf/inch, about 70 lbf/inch, about 80 lbf/inch, about 90 lbf/inch, about 100 lbf/inch, about 110 lbf/inch, about 120 lbf/inch, about 130 lbf/inch, about 140 lbf/inch, or about 150 lbf/inch. In certain embodiments, the plastic membrane is 3 to 20 mils thick. In certain embodiments, the plastic membrane has a thickness of about 3 mils, about 4 mils, about 5 mils, about 6 mils, about 7 mils, about 8 mils, about 9 mils, about 10 mils, about 11 mils, about 12 mils, about 13 mils, about 14 mils, about 15 mils, about 16 mils, about 17 mils, about 18 mils, about 19 mils, or about 20 mils. In certain embodiments, the plastic membrane is a vapor retarder. In certain embodiments, the plastic membrane is a vapor retarder as defined by the International Code Councils, 2012 International Residential Code. In certain embodiments, the plastic membrane is not a vapor retarder as defined by the International Code Councils, 2012 International Residential Code.

In certain embodiments, the plastic membrane is a vapor retarding poly film material. The material may have a tensile strength of 23.33 lbf/inch as measured by ASTM D-882, an elongation at break of 55.9% at a width of 1.02 inches, a perm rating of 0.19, a useable temperature range of −40° F. to 140° F., or any combination thereof. In certain embodiments, the plastic membrane is a fire resistant vapor retarder. Such materials are commercially available from Max Katz Bag Company, Inc. (Indianapolis, Ind.).

In certain embodiments, the plastic membrane is not considered a vapor retarder, with, for example, a thickness of 12 mils as measured by ASTM D5199, a minimum elongation at break of 30% as measured by ASTM D5035, a tensile strength of 115.7 lbs (wide width) as measured by ASTM D4595, an air permeability of 692 cfm as measured by ASTM D737-961, or any combination thereof. Such materials are commercially available from Hanes Companies, Inc. (Tacoma, Wash.).

The plastic membrane can be affixed to structural members using any suitable device for affixing a material to another material. For example, the plastic membrane can be affixed to the structural members using staples, nails, adhesive, or any combination thereof. The sizes of the staples or nails can be adjusted as appropriate to affix the plastic membrane to a face or side of a structural member.

3. FOAM COMPOSITIONS

The disclosed methods can employ polyurethane foam compositions. In certain embodiments, the disclosed methods can employ self-compressing polyurethane foam compositions. Self-compressing polyurethane foam compositions may be preferred in certain embodiments to reduce bulging of the compositions filled into a building cavity. A self-compressing foam will generally resist bulging or blowing out a filled cavity, and as such, can be advantageously coupled with the disclosed methods of using a plastic membrane to cover a building cavity prior to foam application into the cavity.

The most common method of forming polyurethane foams includes the mixing and, subsequent reaction, of a polyol (e.g. a resin composition) with an isocyanate optionally in the presence of a blowing agent. Generally, when the resin composition is mixed with the isocyanate to form a reaction mixture in the presence of the blowing agent, a urethane polymerization reaction occurs. As the urethane polymerization reaction occurs, the reaction mixture cross-links to form the polyurethane and gas is simultaneously formed and released. Through the process of nucleation, the gas foams the reaction mixture thereby forming voids or cells in the polyurethane foam.

The resin composition typically comprises one or more polyols, a cell regulating agent, catalysts, and various other additives. The blowing agent creates the cells in the polyurethane foam. The catalyst controls reaction kinetics to improve the timing of the polymerization reaction by balancing a gel reaction and the blowing agent to create the polyurethane foam. Other additives, such as adhesion promoting agents, may be added to the formulation in order to facilitate wet out of the reaction mixture and promote adhesion of the polyurethane foam to substrates upon which the polyurethane foam is applied. Other additives that are often included within the polyurethane foam include fire retardants.

Suitable blowing agents include compounds with low boiling points which are vaporized during the polymerization reaction. Such blowing agents are generally inert and therefore do not decompose or react during the polymerization reaction. In certain embodiments, at least one of the one or more blowing agents has a gas phase thermal conductivity of less than or equal to 0.016 W/m·K or less than or equal to 0.014 W/m·K or less than or equal to 0.012 W/m·K at 25° C. Examples of inert blowing agents include, but are not limited to, carbon dioxide, chlorofluorocarbons, hydrogenated fluorocarbons, hydrogenated chlorofluorocarbons, acetone, and low-boiling hydrocarbons such as cyclopentane, isopentane, n-pentane, and their mixtures. Specific exemplary blowing agents include, but are not limited to, 1,1,4,4,4-hexafluoro-2-butene; carbon dioxide; hydrocarbons such as pentane, isopentane, cyclopentane petroleum ether, and ether; hydrochlorofluorocarbons such as 1,1-dichloro-1-fluoroethane (HCFC-141b); 2,2-dichloro-1,1,1-trifluoroethane (HCFC-123); 1-chloro-1,1-difluoroethane (HCFC-142b); 1,1,1,2-tetrafluoroethane (HCFC-134a); 1,1,1,3,3-pentafluoropropane (HFC-245fa) available from Honeywell (Morristown, N.J.); 1,1,1,3,3-pentafluorobutane (HFC-365) available as Solkane® 365mfc from Solvay Chemicals (Bruxelles, Belgium); incompletely halogenated hydrocarbons such as 2-chloropropane; fluorocarbons such as dichlorodifluoromethane, 1,2-dichloro-1,1,2,2-tetrafluoroethane (CFC-114), trichlorotrifluoroethane (CFC-113), and trichloromonofluoromethane (CFC-11). In certain embodiments, the blowing agent is water.

Suitable surfactants include, but are not limited to, those sold under the trade name "TEGOSTAB®" by Goldschmidt Chemical Company, such as TEGOSTAB® B-8407 surfactant; TEGOSTAB® B-8474 surfactant; TEGOSTAB® B-2219 surfactant; TEGOSTAB® B-8870 surfactant; TEGOSTAB® B-8433 surfactant; TEGOSTAB® B-8404 surfactant; TEGOSTAB® B-8462 surfactant; TEGOSTAB® B-8467 surfactant; TEGOSTAB® B-8465 surfactant; and TEGOSTAB® B-8470 surfactant. Another example of a suitable surfactant is SURFONIC® N-120 surfactant which is commercially available from Huntsman Petrochemical Corporation of The Woodlands, Tex. Surfactants may also include silicone surfactants and combinations of surfactants. In certain embodiments, about 0.1% to about 5% by weight of surfactant based on the total weight of all foaming ingredients are used. In certain embodiments, about 1.5% to about 3% by weight of surfactant based on the total weight of all foaming ingredients are used.

Suitable flame retardants include, but are not limited to, tris(2-chloropropyl)phosphate (TCPP), tris(2-chloroethyl) phosphate (TCEP), dimethylmethylphosphonate (DMMP), and diethylene glycol (DEG) and propylene glycol (PG) esters of tetrabromophthalic anhydride (ME-TBPA).

The foam compositions can include one or more catalysts. Suitable catalysts include, but are not limited to, tin catalysts (e.g., dimethylbis[(1-oxoneodecyl)oxy] stannane)).

A variety of other ingredients may be included in the formulations for making foams. Examples of optional components include, but are not limited to, cell stabilizers such as silicones, crosslinking agents, chain extenders, pigments, preservatives, antioxidants, reinforcing agents, antistatic agents, fillers and combinations of any of these.

The foam compositions can be applied using spray foam equipment. The spray foam equipment may include separate containers for each of the A-side and B-side components. The containers can each be in fluid connection with a separate conduit, which each are in fluid communication with a mixing chamber which in turn is in fluid communication with a nozzle. Upon opening the containers (via the opening of a suitable valve in each of the containers), the A-side component and B-side component can be dispensed from their containers into the respective conduits, where the components may at least partially expand. The A-side and B-side components may then be brought to the mixing chamber, optionally under pressure from an electric or hydraulic pump, and combined in a mixing device to form a reaction mixture. The mixing device may be a static mixer, a mix chamber, or other mixhead. The reaction mixture can then be expelled through a nozzle or other orifice. The expelled reaction mixture typically forms a spray which is directed to a mold or other surface upon which the polymeric foam is to be applied. The reaction mixture is then cured. Suitable spray foam equipment includes that described in, for example, U.S. Pat. No. 8,568,104, which is herein fully incorporated by reference in its entirety. An exemplary electric pump and proportioner that may be used includes an electric foam proportioner for medium- to high-output foam insulation applications that applies up to 30 lb (13.6 kg) per minute (e.g., Reactor E-20 available from Graco, Minneapolis, Minn.). An exemplary hydraulic pump and proportioner that may be used includes a hydraulic foam proportioner for medium to high-output foam applications and roofing projects that applies up to 52 lb (23.6 kg) per minute (e.g., Reactor H-25, H-40 or H-50 available from Graco). An exemplary air purge spray gun may be a plural-component spray gun for high output spray polyurethane foam and polyurea applications, available from Graco.

In certain embodiments, a preblend of certain materials is prepared prior to reacting the foam components. For example, foam expansion agents, surfactants, catalysts and other foaming ingredients can each individually be blended with one or both of the foam reactants to provide one or more blends of the reaction components; and then the respective blend(s) can be combined to provide the reaction mixture resulting in a foam composition. Alternatively, all the foaming ingredients may be introduced individually to the mixing zone where the foam reactants are contacted. It is also possible to pre-react all or a portion of the foam reactants to form a prepolymer.

The disclosed foam compositions can have one or more advantageous properties.

The foam compositions may have advantageous thermal insulation properties. The effectiveness of thermal insulation is measured by its thermal resistance. In the insulation industry, the standard measure of an insulator's ability to resist thermal energy transfer is referred to as the insulation's R-value. The higher the R-value, the more effective the insulation. Knowing a material's R-value allows contractors, building inspectors, and homeowners to compare products and calculate the amount of insulation needed for a particular construction project. Additionally, regulatory agencies use R-values to establish recommended or mandatory guidelines for new buildings. The disclosed foam compositions may have an R value of 3.5 to 8° F.-ft$^2$-h/BTU per inch. The foam compositions may have an R value of 3° F.-ft$^2$-h/BTU per inch or greater, 4° F.-ft$^2$-h/BTU per inch or greater, 5° F.-ft$^2$-h/BTU per inch or greater, 6° F.-ft$^2$-h/BTU per inch or greater, 7° F.-ft$^2$-h/BTU per inch or greater, or 8° F.-ft$^2$-h/BTU per inch or greater.

The foam compositions may have a glass transition temperature of 40° C. to 150° C.

The foam compositions may have a foam density of 0.1 lb/ft$^3$ to 30 lb/ft$^3$, 0.5 lb/ft$^3$ to 10 lb/ft$^3$, 1.5 lb/ft$^3$ to 10 lb/ft$^3$, or 1.7 lb/ft$^3$ to 3.5 lb/ft$^3$.

The foam compositions may have a cream time of 1 second to 5 seconds, or 2 seconds to 4 seconds. The foam compositions may have a start to rise time of 2 seconds to 17 seconds, or 4 seconds to 8 seconds. The foam compositions may have a tack free time of 4 seconds to 30 seconds, or 8 seconds to 12 seconds.

The foam compositions may be resistant to molding or fungus growth, as measured by ASTM C1338. The foam compositions may not serve as a food source for insects or rodents.

The foam compositions may have negligible air infiltration, as measured according to ASTM E283-04. The foam compositions may have a water vapor infiltration of greater than 1 perm or $5.72\times10^{-8}$ g/Pa-s-m$^2$. The foam compositions may have a water vapor infiltration of greater than 40 perm (e.g., for an open-cell foam).

The fully cured foam compositions may have little or no odor.

4. KITS

Disclosed are kits for conveniently and effectively implementing the disclosed methods. Such kits may include foam reactants, plastic membrane materials, devices and components for affixing the plastic membrane, and optionally one or more of instructions, packaging, and dispensers. Kit components may be packaged for either manual or partially or wholly automated practice of the foregoing methods. In other certain embodiments, a kit includes the foam reactants, and optionally instructions for their application as a foam material.

5. EXEMPLARY EMBODIMENTS

For reasons of completeness, various aspects of the disclosure are set out in the following numbered clauses:

Clause 1. A method of applying a foam composition to a cavity of a structure, the method comprising: introducing a foam composition into a cavity defined by a first wall, a first structural member having a face and sides, a second structural member having a face and sides, an upper structural member having a face, a lower structural member having a face, and a plastic membrane affixed to the face of the first and the second structural members, the face of the upper and lower structural members, and at least one side of each of the first and second structural members to tighten the membrane over a space between the first and second structural members.

Clause 2. The method of clause 1, wherein the plastic membrane has a first edge, a second edge, a third edge, and a fourth edge, wherein the first edge of the plastic membrane is affixed to the upper structural member, the second edge of the plastic membrane is affixed to the lower structural member, the third edge of the plastic membrane is affixed to the first structural member, and the fourth edge of the plastic membrane is affixed to the second structural member.

Clause 3. The method of clause 1 or clause 2, wherein the plastic membrane is affixed to the first and second structural members along the length of the structural members between the upper and lower structural members.

Clause 4. The method of any one of clauses 1-3, wherein the plastic membrane is affixed to the faces of the structural members with staples.

Clause 5. The method of clause 4, wherein the staples are located about 0.1 inch to about 2 inches apart from each other along the face of the structural members.

Clause 6. The method of any one of clauses 1-5, wherein the plastic membrane is affixed to the sides of the first and second structural members with staples.

Clause 7. The method of clause 6, wherein the staples are 0.5-inch or 1-inch staples.

Clause 8. The method of clause 6 or clause 7, wherein the staples that affix the plastic membrane to the sides of the first and second structural members are inset on the sides of the first and second structural members about 0.3 inch to about 1 inch back from the face of the first and second structural members to tighten the membrane over a space between the first and second structural members.

Clause 9. The method of any one of clauses 1-8, wherein the staples that affix the plastic membrane to the sides of the first and second structural members are inset on the sides of the first and second structural members about 0.5 inch back from the face of the first and second structural members to tighten the membrane over a space between the first and second structural members.

Clause 10. The method of any one of clauses 1-9, wherein the staples that affix the plastic membrane to the sides of the first and second structural members are located about 0.5 inch to about 3 inches apart from each other along the side of the first and second structural members.

Clause 11. The method of any one of clauses 1-10, wherein the staples that affix the plastic membrane to the sides of the first and second structural members are located about 1.5 inch apart from each other along the side of the first and second structural members.

Clause 12. The method of any one of clauses 1-11, wherein the plastic membrane is a poly membrane.

Clause 13. The method of any one of clauses 1-12, wherein the plastic membrane is a polyethylene or polypropylene membrane.

Clause 14. The method of any one of clauses 1-13, wherein the plastic membrane is a fiber reinforced polyethylene or polypropylene membrane.

Clause 15. The method of any one of clauses 1-14, wherein the plastic membrane is a spunbond material.

Clause 16. The method of any one of clauses 1-15, wherein the plastic membrane has a tensile strength of about 10 lbf/inch to about 150 lbf/inch.

Clause 17. The method of any one of clauses 1-16, wherein the plastic membrane is 3-20 Mils thick.

Clause 18. The method of any one of clauses 1-17, wherein the plastic membrane is a vapor retarder.

Clause 19. The method of any one of clauses 1-18, wherein the plastic membrane is a vapor retarder as defined by the International Code Councils, 2012 International Residential Code.

Clause 20. The method of any one of clauses 1-17, wherein the plastic membrane is not a vapor retarder as defined by the International Code Councils, 2012 International Residential Code.

Clause 21. The method of any one of clauses 1-20, wherein the foam is an open cell polyurethane foam.

Clause 22. The method of any one of clauses 1-21, wherein the foam is an open cell self-compressing polyurethane foam.

Clause 23. The method of any one of clauses 1-22, wherein the foam composition as filled into the cavity presents a convex shape.

Clause 24. The method of any one of clauses 1-23, wherein introducing the foam composition into the cavity comprises spraying or injecting the foam into the cavity.

Clause 25. The method of any one of clauses 1-24, wherein introducing the foam composition into the cavity comprises piercing the plastic membrane with a spray foam gun with a spray tip and applying the foam composition into the cavity.

Clause 26. The method of any one of clauses 1-25, wherein introducing the foam composition into the cavity comprises applying the foam in increments to provide a foam having a length of about 3 feet along the first and second structural members.

Clause 27. The method of any one of clauses 1-26, wherein the foam composition has a lower operating limit of about 70° F.

Clause 28. The method of any one of clauses 1-27, wherein the foam composition has an upper operating limit of about 160° F.

Clause 29. The method of any one of clauses 1-28, wherein the foam composition does not substantially extend beyond the plane defined by the faces of the first and second structural members.

Clause 30. The method of any one of clauses 1-29, wherein the amount of waste foam is less than or equal to 15%.

Clause 31. The method of any one of clauses 1-30, wherein the amount of waste foam is less than or equal to 10%.

Clause 32. The method of any one of clauses 1-31, wherein the amount of waste foam is less than or equal to 5%.

Clause 33. The method of any one of clauses 1-32, wherein the cavity is a building cavity.

Clause 34. The method of any one of clauses 1-33, wherein the first and second structural members are vertical structural members.

Clause 35. The method of any one of clauses 1-34, wherein the upper and lower structural members are horizontal structural members.

Clause 36. A method of applying a foam composition to a building structure, the method comprising: introducing a foam composition into a plurality of enclosed cavities, the cavities being defined by a plastic membrane affixed to faces of an upper horizontal structural member and a lower horizontal structural member, faces of a plurality of vertical structural members, and sides of the plurality of the vertical structural members to tighten the membrane over the spaces between the vertical structural members.

Clause 37. The method of clause 36, wherein the foam composition is applied in increments into the plurality of cavities to build 3 foot high columns of foam in each cavity.

Clause 38. The method of any one of clauses 1-37, wherein a rigid shield or metal screen configured to overlay the plastic membrane is not used in the method.

Clause 39. The method of any one of clauses 1-38, wherein the foam is not applied to the faces of the structural members.

Clause 40. The method of any one of clauses 1-39, wherein drywall is directly applied to the cavity or cavities after introduction of the foam.

Clause 41. The method of any one of clauses 1-40, wherein the presence of the plastic membrane during introduction of the foam reduces exposure to airborne isocyanate droplets.

Clause 42. A method of preparing a cavity in a structure for introduction of a foam composition, the method comprising: affixing a plastic membrane to faces of vertical and horizontal structural members, and to at least one side of a first and second vertical structural member to tighten the membrane over a space between the first and second vertical structural members.

Clause 43. The method of any one of clauses 1-42, wherein the foam provides structure or insulating support.

Clause 44. A building structure comprising: a cavity defined by a first wall; a first structural member having a face and sides; a second structural member having a face and sides; an upper structural member having a face; a lower structural member having a face; and a plastic membrane affixed to at least one of the face of the first structural member, the face of the second structural member, the face of the upper structural member, the face of the lower structural member, and at least one of the sides of the first and second structural members to tighten the membrane over a space between the first and second structural members; and a foam composition in at least a portion of the cavity, the foam composition imparting structural or insulation support.

Clause 45. The building structure of clause 44, wherein the plastic membrane is affixed to the face of the first structural member, the face of the second structural member, the face of the upper structural member, the face of the lower structural member, and a side of the first and second structural members.

Clause 46. A method of applying a foam composition to a cavity, the method comprising: providing a cavity defined by a first wall, a side of a first vertical structural member, a side of a second vertical structural member, a bottom side of an upper horizontal structural member, a top side of a bottom horizontal structural member, and a plastic membrane, wherein providing the cavity comprises (i) affixing the plastic membrane to the faces of the vertical and horizontal structural members; and (ii) affixing the plastic membrane to the sides of the first and second vertical structural members along the length of the vertical structural members to tighten the membrane over the space between the first and second vertical structural members; and providing a foam composition into the cavity.

Clause 47. The method of clause 46, wherein the plastic membrane has a first edge, a second edge, a third edge, and a fourth edge, wherein step (i) includes affixing the first edge of the plastic membrane to the upper horizontal structural member, the second edge of the plastic membrane to the lower horizontal structural member, the third edge of the plastic membrane to the first vertical structural member, and the fourth edge of the plastic membrane to the second vertical structural member.

Clause 48. The method of clause 46 or clause 47, wherein step (i) includes hand-tightening the plastic membrane as it is affixed to the structural members.

Clause 49. The method of any one of clauses 46-48, wherein step (i) includes affixing the plastic membrane to the faces of the vertical and horizontal structural members with staples.

Clause 50. The method of clause 49, wherein the staples used in step (i) are located about 0.1 inch to about 2 inches apart from each other along the face of the structural members.

Clause 51. The method of any one of clauses 46-50, wherein step (ii) includes affixing the plastic membrane to the sides of the vertical structural members with staples.

Clause 52. The method of clause 51, wherein the staples used in step (ii) are 0.5-inch or 1-inch staples.

Clause 53. The method of any one of clauses 46-52, wherein the staples used in step (ii) are inset on the side of the vertical structural members about 0.3 inch to about 1 inch back from the face of the vertical structural members to tighten the membrane over the space between the first and second vertical structural members.

Clause 54. The method of any one of clauses 46-53, wherein the staples used in step (ii) are inset on the side of the vertical structural members about 0.5 inch back from the face of the vertical structural members to tighten the membrane over the space between the first and second vertical structural members.

Clause 55. The method of any one of clauses 46-54, wherein the staples used in step (ii) are located about 0.5 inch to about 3 inches apart from each other along the side of the vertical structural member.

Clause 56. The method of any one of clauses 46-55, wherein the staples used in step (ii) are located about 1.5 inch apart from each other along the side of the vertical structural member.

Clause 57. The method of any one of clauses 46-56, wherein the plastic membrane is a poly membrane.

Clause 58. The method of any one of clauses 46-57, wherein the plastic membrane is a polyethylene or polypropylene membrane.

Clause 59. The method of any one of clauses 46-58, wherein the plastic membrane is a fiber reinforced polyethylene or polypropylene membrane.

Clause 60. The method of any one of clauses 46-59, wherein the plastic membrane is a spunbond material.

Clause 61. The method of any one of clauses 46-60, wherein the plastic membrane has a tensile strength of about 10 lbf/inch to about 150 lbf/inch.

Clause 62. The method of any one of clauses 46-61, wherein the plastic membrane is 3-20 Mils thick.

Clause 63. The method of any one of clauses 46-62, wherein the plastic membrane is a vapor retarder.

Clause 64. The method of any one of clauses 46-63, wherein the plastic membrane is a vapor retarder as defined by the International Code Councils, 2012 International Residential Code.

Clause 65. The method of any one of clauses 46-62, wherein the plastic membrane is a breathable fabric.

Clause 66. The method of any one of clauses 46-65, wherein the foam is an open cell polyurethane foam.

Clause 67. The method of any one of clauses 46-66, wherein the foam is an open cell self-compressing polyurethane foam.

Clause 68. The method of any one of clauses 46-67, wherein the foam composition as filled into the cavity presents a convex shape.

Clause 69. The method of any one of clauses 46-68, wherein providing the foam composition into the cavity comprises spraying or injecting the foam into the cavity.

Clause 70. The method of any one of clauses 46-69, wherein providing the foam composition into the cavity comprises piercing the plastic membrane with a spray foam gun with a spray tip and applying the foam composition into the cavity.

Clause 71. The method of any one of clauses 46-70, wherein providing the foam composition into the cavity comprises applying the foam in increments to provide a foam having a length of about 3 feet along the first and second vertical structural members.

Clause 72. The method of any one of clauses 46-71, wherein the foam composition has a lower operating limit of about 70° F., about 90° F., about 105° F., or about 115° F.

Clause 73. The method of any one of clauses 46-72, wherein the foam composition has an upper operating limit of about 135° F. or about 160° F.

Clause 74. The method of any one of clauses 46-73, wherein the foam composition does not substantially extend beyond the plane defined by the faces of the first and second vertical structural members.

Clause 75. The method of any one of clauses 46-74, wherein the amount of waste foam is less than or equal to 15%.

Clause 76. The method of any one of clauses 46-75, wherein the amount of waste foam is less than or equal to 10%.

Clause 77. The method of any one of clauses 46-76, wherein the amount of waste foam is less than or equal to 5%.

Clause 78. The method of any one of clauses 46-77, wherein the cavity is a building cavity.

Clause 79. A method of applying a foam composition to a building structure comprising a first wall, an upper horizontal structural member, a lower horizontal structural member, and a plurality of vertical structural members, the method comprising: providing a plurality of enclosed cavities by affixing a plastic membrane to the faces of the structural members along the length of the members, and affixing the plastic membrane to the sides of the vertical structural members along the length of the vertical structural members to tighten the membrane over the spaces between the vertical structural members; and providing a foam composition into the plurality of cavities.

Clause 80. The method of clause 79, wherein the foam composition is applied in increments into the plurality of cavities to build 3 foot high columns of foam in each cavity.

Clause 81. The method of any one of clauses 46-80, wherein a rigid shield or metal screen configured to overlay the plastic membrane is not used in the method.

Clause 82. The method of any one of clauses 46-81, wherein the foam is not applied to the faces of the vertical and horizontal structural members.

Clause 83. The method of any one of clauses 46-82, wherein drywall is directly applied to the cavity or cavities after application of the foam.

Clause 84. The method of any one of clauses 46-83, wherein the presence of the plastic membrane during application of the foam reduces exposure to airborne isocyanate droplets.

Clause 85. A method of applying a plastic membrane to a cavity in preparation for application of a foam composition to the cavity, the cavity defined by a first wall, a side of a first vertical structural member, a side of a second vertical structural member, a bottom side of an upper horizontal structural member, and a top side of a lower horizontal structural member, the method comprising: affixing a plastic membrane to the faces of the vertical and horizontal structural members along the length of the members; and affixing the plastic membrane to the sides of the first and second vertical structural members along the length of the vertical structural members to tighten the membrane over the space between the first and second structural members.

It is understood that the foregoing detailed description and accompanying examples are merely illustrative and are not to be taken as limitations upon the scope of the invention, which is defined solely by the appended claims and their equivalents.

Various changes and modifications to the disclosed embodiments will be apparent to those skilled in the art. Such changes and modifications, including without limitation those relating to the chemical structures, substituents, derivatives, intermediates, syntheses, compositions, formulations, or methods of use of the invention, may be made without departing from the spirit and scope thereof.

What is claimed is:

1. A method of applying a foam composition to a structure including a first wall, a first structural member, a second structural member opposite the first structural member, an upper structural member, and a lower structural member, the method comprising:

affixing a plastic membrane to a face of each of the first and second structural members, a face of the upper structural member, and a face of the lower structural member;

stretching the plastic membrane beyond its elastic limit around the opposite sides of each of the first and second structural members to tighten the membrane over a space between the first and second structural members;

affixing the plastic membrane to the opposite sides of each of the first and second structural members; and introducing a foam composition into a cavity defined by the first wall, the first structural member, the second structural member, the upper structural member, the lower structural member, and the plastic membrane.

2. The method of claim 1, wherein the plastic membrane has a first edge, a second edge, a third edge, and a fourth edge, wherein the first edge of the plastic membrane is affixed to the upper structural member, the second edge of the plastic membrane is affixed to the lower structural member, the third edge of the plastic membrane is affixed to the first structural member, and the fourth edge of the plastic membrane is affixed to the second structural member.

3. The method of claim 1, wherein the plastic membrane is affixed to the first and second structural members along the length of the structural members between the upper and lower structural members.

4. The method of claim 1, wherein the plastic membrane is affixed to the faces of the structural members with staples.

5. The method of claim 4, wherein the staples are located about 0.1 inch to about 2 inches apart from each other along the face of the structural members.

6. The method of claim 1, wherein the plastic membrane is affixed to the sides of the first and second structural members with staples.

7. The method of claim 6, wherein the staple extends through a single layer of the plastic membrane to affix the plastic membrane to the sides of the first and second structural members.

8. The method of claim 6, wherein the staples that affix the plastic membrane to the sides of the first and second structural members are inset on the sides of the first and second structural members about 0.3 inch to about 1 inch back from the face of the first and second structural members.

9. The method of claim 1, wherein the staples that affix the plastic membrane to the sides of the first and second structural members are located about 0.5 inch to about 3 inches apart from each other along the side of the first and second structural members.

10. The method of claim 1, wherein the plastic membrane is a polyethylene or polypropylene membrane, a fiber reinforced polyethylene or polypropylene membrane, or a spunbond material.

11. The method of claim 1, wherein introducing the foam composition into the cavity comprises spraying or injecting the foam into the cavity.

12. The method of claim 1, wherein introducing the foam composition into the cavity comprises piercing the plastic membrane with a spray tip of a spray foam gun to create a hole in the plastic membrane where none had previously existed and applying the foam composition into the cavity.

13. The method of claim 12, wherein the foam discharged from the spray foam gun is an open cell self-compressing polyurethane foam.

14. The method of claim 1, wherein introducing the foam composition into the cavity comprises applying the foam in increments to provide a foam having a length of about 3 feet along the first and second structural members.

15. The method of claim 1, wherein the foam composition does not substantially extend beyond a plane defined by the faces of the first and second structural members.

16. The method of claim 1, wherein drywall is directly applied to the cavity or cavities after introduction of the foam.

17. The method of claim 1, wherein the foam is a self-compressing foam that, when introduced into the cavity, expands throughout the cavity before undergoing compression, and wherein introducing the foam composition into the cavity further comprises stretching a portion of the plastic membrane between the respective sides of the first and second structural members beyond an elastic limit of the plastic membrane by expansion of the foam prior to undergoing compression.

18. A building structure comprising:

a cavity defined by a first wall;

a first structural member having a face and sides;

a second structural member having a face and sides;

an upper structural member having a face;

a lower structural member having a face; and a plastic membrane affixed to at least one of the face of the first structural member, the face of the second structural member, the face of the upper structural member, and the face of the lower structural member, the plastic membrane also being stretched beyond its elastic limit around the opposite sides of each of the first and second structural members, and affixed to the opposite sides of the first and second structural members, to tighten the membrane over a space between the first and second structural members; and a foam composition in at least a portion of the cavity, the foam composition imparting structural or insulation support.

19. The building structure of claim 18, wherein the plastic membrane is affixed to the face of the first structural member, the face of the second structural member, the face of the upper structural member, the face of the lower structural member, and the opposite sides of each of the first and second structural members.

20. The building structure of claim 18, further comprising:

a first plurality of staples extending through a single layer of the plastic membrane and into a first of the opposite sides of the first structural member; and a second plurality of staples extending through the single layer of the plastic membrane and into a second of the opposite sides of the first structural member.

* * * * *